US010036168B2

(12) United States Patent
Bordin

(10) Patent No.: US 10,036,168 B2
(45) Date of Patent: Jul. 31, 2018

(54) RAISED FLOOR COMPRISING A PROFILED ELEMENT

(71) Applicant: PROGRESS PROFILES SPA, Asolo (IT)

(72) Inventor: Dennis Bordin, Asolo (IT)

(73) Assignee: PROGRESS PROFILES SPA, Asolo (IT)

( * ) Notice: Subject to any disclaimer, the term of this patent is extended or adjusted under 35 U.S.C. 154(b) by 0 days.

(21) Appl. No.: 15/664,731

(22) Filed: Jul. 31, 2017

(65) Prior Publication Data

US 2018/0038117 A1 Feb. 8, 2018

(30) Foreign Application Priority Data

Aug. 3, 2016 (IT) ..... 102016000081448

(51) Int. Cl.
*E04B 9/00* (2006.01)
*E04F 15/024* (2006.01)

(52) U.S. Cl.
CPC .. *E04F 15/02458* (2013.01); *E04F 15/02452* (2013.01)

(58) Field of Classification Search
CPC ..... E04F 15/02458; E04F 15/02452; E04F 19/061; E04F 15/02494; E04F 19/064; A47B 13/083
See application file for complete search history.

(56) References Cited

U.S. PATENT DOCUMENTS 3,606,714 A * 9/1971 Arnett ..... E04F 19/061 52/255
6,338,229 B1 * 1/2002 Botzen ..... E04F 13/06 52/287.1
2006/0080939 A1 * 4/2006 Bledsoe ..... E04F 13/16 52/750
2008/0172962 A1 * 7/2008 Harrison ..... E04F 19/022 52/287.1
2008/0172963 A1 * 7/2008 Harrison ..... E04F 19/022 52/287.1
2009/0056235 A1 * 3/2009 Morsching ..... E04D 13/15 52/58
2011/0163510 A1 * 7/2011 Wedi ..... A47B 13/083 277/644
2012/0110941 A1 * 5/2012 Biro ..... E04F 13/0736 52/578
2012/0255249 A1 * 10/2012 Singh ..... E04F 19/065 52/302.1
2012/0304573 A1 * 12/2012 Aboukhalil ..... E04F 13/0816 52/506.05
2014/0237912 A1 * 8/2014 Kugler ..... E04F 15/02464 52/126.6

FOREIGN PATENT DOCUMENTS

DE 8815671 U1 1/1989
DE 202004018996 U1 3/2005
DE 202009013314 U1 2/2010
WO 2008088886 A1 7/2008

* cited by examiner

*Primary Examiner* — Brian D Mattei
(74) *Attorney, Agent, or Firm* — Cantor Colburn LLP

(57) ABSTRACT

A profiled element for laying raised floors, which comprises a first flat portion that extends longitudinally and a second flat portion that extends longitudinally in the same direction as the first portion and is arranged transversely with respect to the arrangement of the first portion, grip protrusions for an adhesive for coverings or floors being defined on the second flat portion.

10 Claims, 3 Drawing Sheets

RAISED FLOOR COMPRISING A PROFILED ELEMENT

CROSS REFERENCE TO RELATED APPLICATIONS

This application is related to and claims the benefit of Italian Patent Application No. 102016000081448, filed on Aug. 3, 2016, the contents of which are herein incorporated by reference in their entirety.

TECHNICAL FIELD

The present disclosure relates to a profiled element for laying raised floors, and a raised floor that comprises such profiled element.

BACKGROUND

Nowadays, for laying raised floors, supports are used which are placed on the ground, such as posts, on which are laid tiles or other covering elements; at the perimetric edges, in order to hide the gap underneath the covering or flooring, today longitudinally-extended profiled elements with a T-shaped cross-section are adopted, which comprise a first flat portion that extends longitudinally, which rests on a plurality of lifting posts, and a second flat portion that extends longitudinally in the same direction as the first portion and which is arranged perpendicular to the arrangement of the first portion, and which, with it, defines the aforementioned T-shaped cross-section.

The second flat portion extends, upward from below in a configuration for use, to cover from view what is arranged below the covering or flooring, as well as the lateral surface of the perimeter of the covering or flooring proper.

Such solution has a rather unappealing visual impact when the raised floor has a perimetric step in which the vertical part is constituted by elements of the same covering as the floor, only arranged vertically, since such vertical covering elements are partially covered by the second, vertical portion of the T-shaped profiled element.

An alternative that is known and widespread today entails locking the vertical covering elements in place with clip fasteners; such system with clips, although more discreet and therefore preferable from the point of view of visual impact, entail placing at least one clip for each vertical covering element, with consequent time and cost for mounting the clips on the supports and then mounting the vertical covering elements on the clips.

SUMMARY

The aim of the present disclosure is to provide a profiled element for laying raised floors which is capable of overcoming the limitations of conventional systems for covering the sides of raised floors.

Within this aim, the present disclosure provides a raised floor that comprises such profiled element.

The present disclosure also provides a profiled element that is easy to lay and intuitive to use.

The present disclosure further provides a profiled element that allows the easy fixing of vertical covering elements.

This aim and these and other advantages which will become better evident hereinafter are achieved by providing a profiled element for laying raised floors according to claim 1 and by a raised floor that comprises such profiled element according to claim 10.

BRIEF DESCRIPTION OF THE DRAWINGS

Further characteristics and advantages of the disclosure will become better apparent from the description of two preferred, but not exclusive, embodiments of the profiled element according to the disclosure, which are illustrated by way of non-limiting example in the accompanying drawings wherein.

DETAILED DESCRIPTION OF THE DRAWINGS

Figure 1:
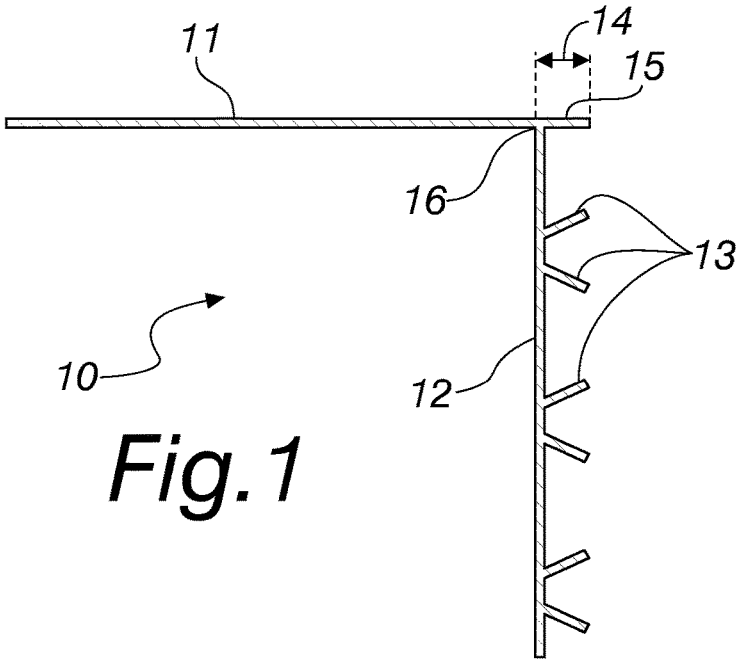
FIG. 1 is a cross-sectional view of a profiled element according to the disclosure in a first embodiment thereof.

With reference to FIGS. 1-7, a profiled element for laying raised floors according to the disclosure is generally designated in a first embodiment thereof with the reference numeral 10.

Such profiled element 10 comprises a first flat portion 11 that extends longitudinally and a second flat portion 12 that extends longitudinally in the same direction as the first portion 11 and which is arranged transversely with respect to the arrangement of the first portion 11.

The second flat portion 12 extends downward from the first portion 11, with respect to a configuration for use.

Grip protrusions 13 are defined on the second flat portion 12, for an adhesive for coverings or floors.

On the first portion 11 openings 46 can be defined for better outflow of water.

Such adhesive for coverings or floors is, for example, a cement adhesive of conventional type, such as silicone or other suitable types available on the market.

In such exemplary embodiment, which is obviously non-limiting of the disclosure, the second flat portion 12 is perpendicular to the first flat portion 11 and defines with it a substantially L-shaped cross-section.

The protrusions 13 are constituted by a series of flat longitudinal ribs, which protrude outward with respect to a laying configuration and are inclined with respect to the arrangement of the second portion 12.

The inclination of each raised portion 13 is at an identical angle to, and in the opposite direction from, another nearby protrusion 13.

Such protrusions 13 have the same height 14 as the second flat portion 12.

Such profiled element 10 also comprises a flange 15 of the first portion 11, which therefore has the same arrangement, which protrudes beyond the line 16 for connection with the second portion 12.

Such flange 15 extends beyond the connecting line 16 for a length that corresponds to the height 14 of the protrusions 13.

The function of such flange 15 is to contain an adhesive for coverings or for floors.

Figure 2:
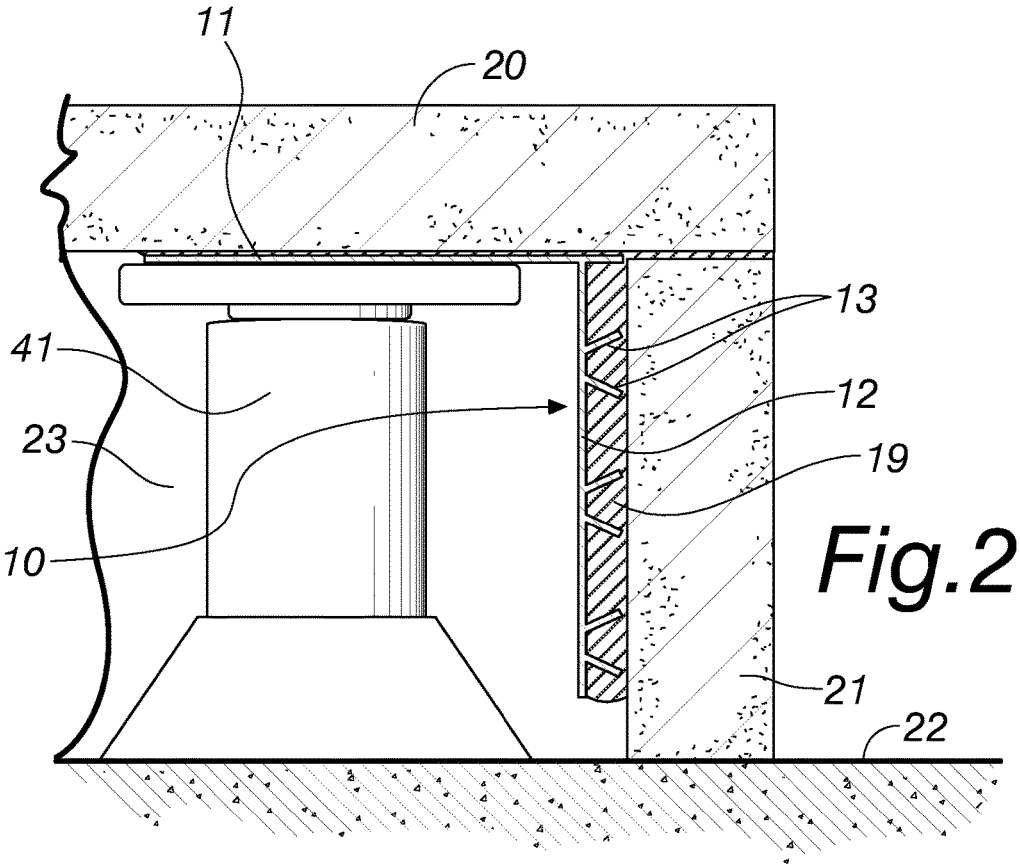
FIG. 2 shows the profiled element in FIG. 1 applied to a raised floor.

FIG. 2 shows a cross-section of a profiled element 10 applied to a raised floor.

The first portion 11 of the profiled element 10 is laid on a supporting post 41, while the second portion 12 is covered with adhesive 19.

A horizontal flooring or covering element 20, for example a tile, is laid on the first portion 11, while a vertical flooring or covering element 21 is laid on the adhesive 19 on the second portion 12; such vertical flooring or covering element can be constituted by a part of a tile identical to the horizontal flooring or covering element 20, conveniently cut so that it descends to ground level 22, so as to optimally conceal the gap 23 defined below the raised floor.

Figure 3:
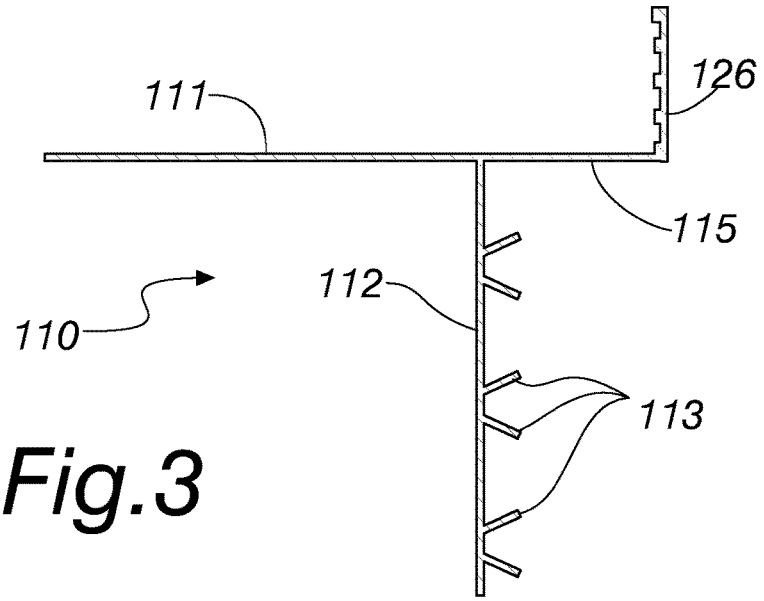
FIG. 3 is a cross-sectional view of a profiled element according to the disclosure in a second embodiment thereof.

In FIG. 3, a profiled element for laying raised floors according to the disclosure is generally designated in a second embodiment thereof with the reference numeral 110.

The profiled element 110 comprises a first flat portion 111 that extends longitudinally and a second flat portion 112 that extends longitudinally in the same direction as the first portion 111 and is arranged transversely with respect to the arrangement of the first portion 111.

Grip protrusions 113 are defined on the second flat portion 112, for an adhesive for coverings or floors.

In such exemplary embodiment, which is obviously non-limiting of the disclosure, the second flat portion 112 is perpendicular to the first flat portion 111 and defines with it a substantially L-shaped cross-section.

The protrusions 113 are similar to the protrusions 13 described above.

The profiled element 110 also comprises a flange 115 of the first portion 111, which therefore has the same arrangement, which protrudes beyond the line 116 for connection with the second portion 112.

From the free end of the flange 115 a longitudinal edge 126 extends upward, with respect to a configuration for use, to cover and protect a lateral face 127 of a horizontal flooring or covering element 120 that is adjacent to the longitudinal edge 126.

The longitudinal edge 126 is, for example, perpendicular to the flange 115.

It should be understood that the longitudinal edge 126 can also have a different cross-section, for example curved, shaped like a circular arc, or like an inverted U, and knurled in an upper region in order to define an anti-slip edge, and other, similar cross-sections.

The flange 115 extends beyond the connection line 116 for a length such as to affect the thickness 125 of a vertical flooring or covering element 121.

The longitudinal edge for covering and protection 126 provides the protection of the lateral face 127 of the horizontal flooring or covering element 120 against unwanted shocks that could damage the lateral face 127 which, if chipped, would be disfigured from the point of view of the visual impact.

The longitudinal edge 126 has a height that corresponds to the thickness of the horizontal flooring or covering element 120, so as to protect it without presenting an obstacle to walking.

Figure 4:
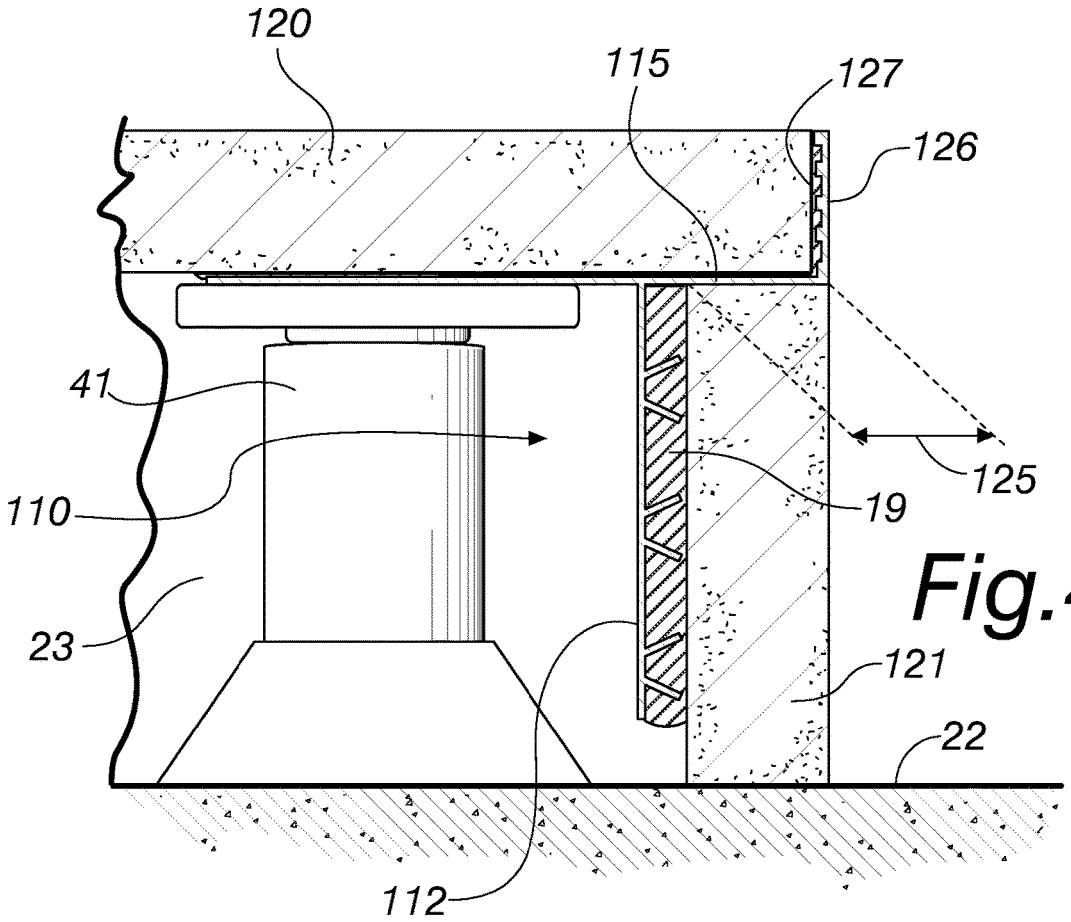
FIG. 4 shows the profiled element in FIG. 3 applied to a raised floor.

FIG. 4 shows a cross-section of a profiled element 110 applied to a raised floor.

The first portion 111 of the profiled element 110 is laid on a supporting post 41, while the second portion 112 is covered with adhesive 19.

A horizontal flooring or covering element 120, for example a tile, is laid on the first portion 111, while a vertical flooring or covering element 121 is laid on the adhesive 19 on the second portion 112; such vertical flooring or covering element can be constituted by a part of a tile identical to the horizontal flooring or covering element 120, conveniently cut so that it descends to ground level 22, so as to optimally conceal the gap 23 defined below the raised floor.

The disclosure also relates to a raised floor 40 that comprises a profiled element 10 or 110 according to the disclosure.

Figure 7:
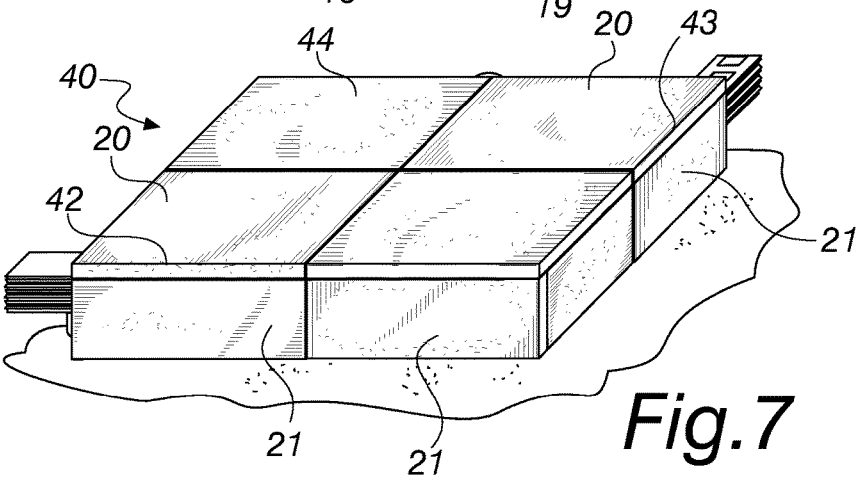

The raised floor 40, which is shown schematically in FIG. 7, comprises an array of lifting supports 18, for example posts, that comprises perimetric lifting supports 41 on which profiled elements 10 as described above are placed, one for each side 42 and 43 of the perimeter of the raised floor 40 that is intended to remain exposed.

The raised floor 40 comprises:

horizontal flooring or covering elements 44, of which the perimetric horizontal flooring or covering elements 20 are adapted to be placed with one edge surmounting the first flat portion 11 of the profiled element 10, vertical flooring or covering elements 21, which are fixed to the second flat portion 12 of the profiled element 10 by way of adhesive 19.

Figure 5:
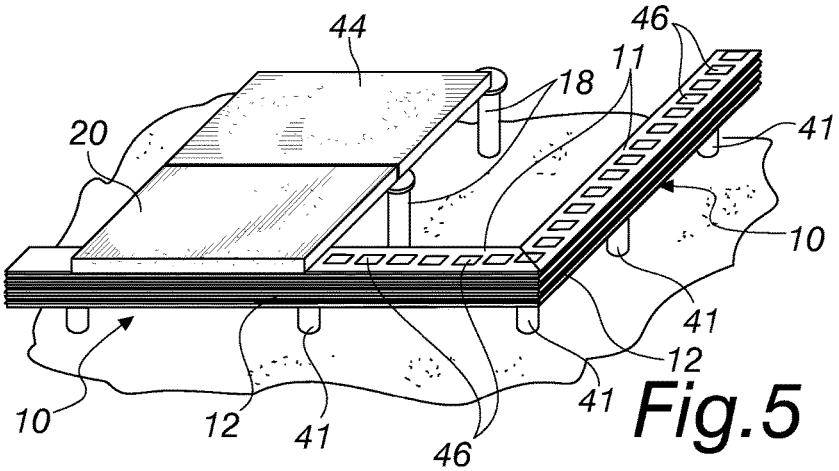
FIGS. 5 to 7 each show a step of laying a raised floor according to the disclosure.

FIG. 5 shows a step of laying a raised floor 40 according to the disclosure, in which on the ordered array of lifting supports, i.e. the posts 18, the profiled elements 10 according to the disclosure, conveniently cut at the corners in order to fit together without overlapping, are placed perimetrically.

Figure 6:
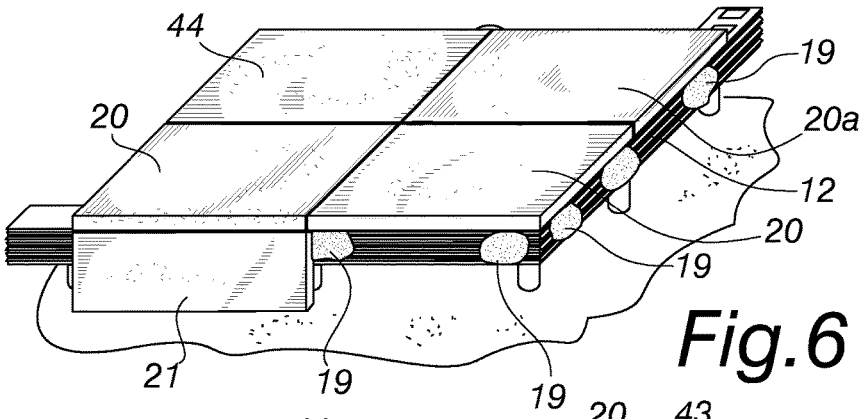

FIG. 6 shows a subsequent step, in which the central and perimetric horizontal flooring or covering elements 44 and 22 respectively are placed and the adhesive 19 for the application of the vertical flooring or covering elements 21 is placed on the second longitudinal portions 12 of the profiled elements 10.

FIG. 7 shows a finished raised floor 40.

In practice it has been found that the disclosure fully achieves the intended aims and advantages.

In particular, with the disclosure, a profiled element has been devised that is easy to lay and intuitive to use, and which allows the easy fixing of vertical flooring or covering elements simply by using conventional adhesives for coverings or floors, placed on the second longitudinal portion of the profiled element, without using clips or other inconvenient coupling systems that remain in view.

Therefore with the disclosure, a profiled element has been devised that, once the raised floor is completed, disappears completely from view, thus optimizing the visual impact of the raised floor.

With the disclosure, a raised floor has also been devised which comprises such a profiled element.

The disclosure thus conceived is susceptible of numerous modifications and variations, all of which are within the scope of the appended claims. Moreover, all the details may be substituted by other, technically equivalent elements.

What is claimed is:

1. A raised floor comprising:

a profiled element for laying raised floors, the profiled element comprising:

a first flat portion that extends longitudinally and a second flat portion that extends longitudinally in the same direction as said first portion and is arranged transversely with respect to the arrangement of said first portion, a plurality of grip protrusions defined on said second flat portion, a flange of said first flat portion extending beyond a connection line that connects the first flat portion with the second flat portion, wherein the profiled element is placed on a lifting support, the lifting support having an upright supporting post disposed beneath the first flat portion, wherein a horizontal covering element is placed on the first flat portion and a vertical covering element is placed on an adhesive on the second flat portion, such that a gap is concealed by the profiled element and the vertical covering element.

2. The raised floor according to claim 1, wherein said second flat portion is perpendicular to the first flat portion and defines a substantially L-shaped cross-section.

3. The raised floor according to claim 1, wherein openings for outflow of water are provided on the first portion.

4. The raised floor according to claim 1, wherein the protrusions are constituted by a series of flat longitudinal ribs, which protrude outward with respect to a laying configuration and are inclined with respect to the arrangement of the second portion.

5. The raised floor according to claim 1, wherein said flange extends beyond the connection line for a length that corresponds to a height of the protrusions.

6. The raised floor according to claim 1, further comprising a longitudinal edge extending upward from a free end of the flange, with respect to a configuration for use, to cover and protect a lateral face of the horizontal covering element that is adjacent to said longitudinal edge.

7. The raised floor according to claim 6, wherein said longitudinal edge is perpendicular to the flange.

8. The raised floor according to claim 6, wherein said flange extends beyond the connection line for a length at least the same as a thickness of the vertical or covering element.

9. The raised floor according to claim 6, wherein said longitudinal edge has a height that corresponds to a thickness of a horizontal flooring or covering element.

10. A raised floor, comprising:

an array of lifting supports, the array including perimetric lifting supports each lifting support having an upright supporting post, profiled elements are placed on the lifting supports, one profiled element for each side of the perimeter of the raised floor that is exposed, wherein each of the profiled elements includes a first flat portion that extends longitudinally and a second flat portion that extends longitudinally in the same direction as said first portion and is arranged transversely with respect to the arrangement of said first portion, a plurality of grip protrusions defined on said second flat portion, a flange of said first flat portion extending beyond a connection line that connects the first flat portion with the second flat portion, a plurality of horizontal flooring or covering elements, of which the perimetric horizontal flooring or covering elements are adapted to be placed with one edge surmounting the first flat portion of the profiled element, and a plurality of vertical flooring or covering elements fixed to the second flat portion of the profiled element by way of an adhesive such that a gap is concealed by the profiled element and the vertical flooring or covering elements.

* * * * *